US005848890A

United States Patent [19]

McCormick

[11] Patent Number: 5,848,890

[45] Date of Patent: Dec. 15, 1998

[54] FURNACE PRODUCT TRANSPORT SYSTEM

[76] Inventor: Edward V. McCormick, 118 O'Brien Rd., Churchville, N.Y. 14428

[21] Appl. No.: 766,811

[22] Filed: Dec. 13, 1996

[51] Int. Cl.[6] ..... F27B 9/26

[52] U.S. Cl. ..... 432/261; 432/122; 432/153

[58] Field of Search ..... 432/5, 121, 122, 432/125, 126, 176, 236, 246, 234, 153, 261

[56] References Cited

U.S. PATENT DOCUMENTS

| | | | |
|---|---|---|---|
| 4,013,403 | 3/1977 | Petrus | 432/122 |
| 4,343,395 | 8/1982 | Lippert et al. | 432/236 |
| 4,596,527 | 6/1986 | Yamada et al. | 432/236 |
| 4,991,276 | 2/1991 | Bricmont | 29/124 |
| 5,007,826 | 4/1991 | Wunning | 432/121 |

*Primary Examiner*—John A. Jeffery
*Assistant Examiner*—Gregory A. Wilson
*Attorney, Agent, or Firm*—James J. Ralabate

[57] ABSTRACT

This invention involves a transport system for moving work products through a furnace or kiln. The structure is simple in construction and moves easily along two grooves or channels provided at both sides of the product supporting structure. The supporting structure is a plurality of cross bars resting on a carrier or carriers on each side thereof. The structure resists warping and rapid deterioration generally occuring in prior art structures. It importantly allows uniform heating of the product because of the open atmosphere provided therein.

14 Claims, 4 Drawing Sheets

FURNACE PRODUCT TRANSPORT SYSTEM

This invention relates to kilns or furnaces and, more specifically, to a novel system for transporting items to be heat treated through the furnace.

BACKGROUND OF THE INVENTION

There are various known structures and methods for transporting products through a heat treating furnace or kiln. Various types of continuous furnaces are differentiated by the means with which the product is transported through the furnace. The major types of furnaces which can be used for parts or powders and their limitations are listed below. There are also other furnace types that can be used only for powders.

Pusher Furnaces require thick plates upon which the product rides. This limits the rate which the product can be heated or cooled. The hearth design required to support the sliding plates is massive and reduces the efficiency with which heat can be introduced from the bottom.

Roller Hearth Furnaces are difficult to use with special atmospheres because the rollers protrude through the wall. The width and weight of the load is limited because the rollers are supported outside the furnace and cause a cantilever. The heat loss caused by the rolls protruding through the walls is high.

Car Bottom Furnaces are difficult to use with special atmospheres. They cannot be heated under the load electrically. Tight temperature uniformity is difficult to maintain.

Rotating Hearth Furnaces are difficult to use with special atmospheres. Tight temperature uniformity is difficult to obtain.

Walking Beam Furnaces are difficult to use with special atmospheres. The pumping action of the beams causes undesirable mixing of the atmosphere. They are difficult to maintain because of their mechanical complexity. They require a large amount of floor space for maintenance.

Mesh Belt Furnaces are limited in temperature and load carrying capacity because the belt is in tension. Alloy belts limit temperature. Ceramic belts are expensive and have a limited length due to the poor strength of ceramics in tension.

Screw Conveyor Furnaces have a limited temperature range. The screw action can damage the product.

Monorail Furnaces are difficult to use with special atmospheres. These furnaces frequently have a slotted roof and the temperature uniformity is not very good. The use of alloy parts limits their temperature range.

Carpet Hearth[198] type furnaces can be heated from the top only which limits the furnace to thin loads. They are difficult to use with special atmospheres.

There are several patents that disclose some of the above-noted prior art structures or systems. Some of these systems are described in U.S. Pat. Nos. 2,022,283; 2,287,740; 2,338,784; 2,434,852; 2,453,845; 3,022,058 and 4,247,379.

In U.S. Pat. No. 2,022,283 (Harris), a transport system is described having hinged portions of a tray movably connected to each other. The tray is made up of bar sections 16 and 18 which intersect at right angles. The shoes and guides of Harris are integral to the trays and hinges and there is only one central push point. Sections 10 of Harris are side by side and hinged together by means of a pintle rod. Channel 32 is centrally located and provides the single pushing point for moving the tray through the furnace. A disadvantage of a single push point is that the transport system may shimmy or wobble thus causing damage and non-uniformity of heating. Also, by a single push point, the center part being pushed will wear out much sooner than the other components. Harris' system is quite complex. Harris indicates that portions of his trays may ultimately be warped so as to render the entire tray inoperative (see pg. 2 lines 49–60) and would require replacement. Thus, the Harris system has several areas that could cause problems such as warping, one push point and a hinged, relatively complex structure.

Klouman U.S. Pat. No. 2,297,740 discloses a tray for heat treating furnaces that is made up of solid segments 18 that fit together to form a substantially solid work supporting surface, see FIG. 3. In solid surfaces the heat is concentrated at the top and sides of the product and the bottom of the work piece adjacent or resting on the solid tray will be heated differently than the exposed portions of the work product. The uniformity of work product heating in systems such as Klouman is not optimized.

Ruckstahl, U.S. Pat. No. 2,338,784, discloses a work support tray for heat surfaces that is made up of metallic components that will permit less stress in use. By using two hinged portions, Ruckstahl allows better flexing than rigid one-piece units and therefore prolongs the life of the supporting tray. Ruckstahl provides flexible rods capable of flexing when subjected to heat within the furnace to permit the tray sections to move relative to each other. While this improvement over one-piece trays extended tray life, its construction was relatively complex and uneven surfaces of tray sections 16 and 17 when not aligned could cause uneven heating of the work piece or pieces.

In Jackson, U.S. Pat. No. 2,434,852, a grid hearth is disclosed which will rest on a furnace hearth and can be removed for insertion into a furnace. Movable bars are loosely mounted for universal twisting movement relative to the supporting rails so that no strain is imparted to the rails or to the bars by relative movements occasioned by any warping action of the members of the grid structure. This twisting movement could result in uneven distancing of the work product from the heat source and thus could result in uneven heating of the product. Once the grid is inserted into the furnace with the product and the product is properly treated, the grid devices are removed from the furnace by means of a forked dolly truck or the like. Jackson, therefore, does not disclose a system for moving a work product through a furnace but rather a system for inserting a stationary grid bearing a product in a furnace which is only moved when removed after treatment.

In a number of the prior art units, work support structures are made into complex embodiments to prevent warping or misalignment of support structure components. Most prior systems use unprotected tracks along which the transport system traverses. These can easily get clogged with debris. Also, most prior art systems have temperature limitations above which damage can be done to the system. The support basket of Bixby et al, U.S. Pat. Nos. 3,022,058 and Duran, 4,427,379, are designed so that they are capable of withstanding repeated heating and quenching without becoming defective. But, as in other cases, in order to avoid defective components or warping, a relatively complex structure and sometimes manually operated system is offered as the solution by Bixby and Duran.

There is therefore a need for a relatively simple structure that will not readily deform or warp and that provides substantially uniform product heating when passed through the length of a furnace or kiln. Also needed is a heat transport system where components are simple, functional, effective and convenient to use.

BACKGROUND OF THE INVENTION

It is therefore an object of this invention to provide a structure and method for conveying material through a furnace devoid of the above-noted disadvantages.

Another object of this invention is to provide a furnace heating system that provides uniform over and under heating of a work product to be treated.

Still a further object of this invention is to provide a system where heat limitations are not a significant problem.

Another object of this invention is to provide a transport system for use in furnaces that uses substantially less fuel than heretofore used systems.

Still a further object is to provide a transport system that has an open atmosphere which is ideal for easy heating and cooling of a work product.

Yet another object of this invention is to provide a heat transport system that has little if any product weight limitations and is generally faster than prior art systems.

Still yet another object of this invention is to provide a heat transport system that is easy to use and easy to clean after use.

These and other objects of this invention are accomplished generally speaking by a push type product transport system having a plurality of aligned, relatively thin cross pieces positioned in spaced relationship to each other. Gaps between these cross pieces permit uniform all around heating of a work piece. These cross pieces are supported on each terminal portion by carriers that hold each cross piece in place. Also, the carriers ensure that each cross piece is held in place on the same horizontal level so that warping as in the prior art is not a major concern. The carriers are slidably positioned in a groove or channel of an outer refractory and are movable therein. To prevent the carriers from any heat degradation, insulation in one embodiment is positioned between the carriers and the supporting cross pieces. The grooves or channels are configured to have a back and front retaining abutment that is adjacent the sides of the carriers and maintains the path through which the carriers will travel through the furnace. The product or product carrier will be placed on cross pieces. These cross pieces can be a variety of geometrys and can include rods, cylinders, wires, square bars, rectangular bars, square tubing, rectangular tubing or other appropriate shapes. The above-mentioned cross pieces would be supported by carriers positioned at or near the ends of the cross pieces. Additional carriers could also be utilized to regulate the span of the unsupported cross piece. The carriers could be used on single or multiple cross pieces. The carriers could also be positioned in from the ends to provide an unsupported, cantilevered portion of the cross piece. Additional width can be provided by using multiple cross pieces set end to end. The material of construction of the above-mentioned cross pieces and carriers can be metal, ceramic (including graphite), intermetallic, composite and/or other materials suitable for the furnace environment. "Intermetallics" are metals which exhibit ceramic-like properties. Examples of intermetallics are iron aluminide and molybdenum disilicide. "Composites" are materials made up of dissimilar materials. Examples of composites are silicon carbide reinforced aluminum and silicon carbide reinforced alumina. The carriers can carry one cross piece or multiple cross pieces. They can have holes to hold the cross piece. They can have indentations in the side or face to hold the cross piece. They can be flat. The carriers can have pins or other features to hold the cross piece in position. The carriers can ride on flat surfaces, in channels, on "V" grooves or in "V" grooves. The carriers can be captive or free. The carriers could be conveyed by pushing, on rollers, on sprockets, on gears, on walking beams or any other appropriate means of transport.

The out board carriers could be shielded from the heat of the furnace by means of fixed baffles, movable baffles affixed to the carrier or cross pieces or a combination of both. This can be used to reduce the temperature of the carriers and transport mechanism.

The carrier/cross piece assembly could be transported under the furnace during the return cycle or it could be transported back to the entrance of the furnace using methods similar to a pusher furnace or through the hot zone or over the furnace.

Fixtures can be used between the cross pieces. The fixtures can be flat, indented, pinned or perforated as appropriate. If the space between the fixtures needs to be filled in, material can be on or over the cross piece as appropriate to the product material handling. This system can be used in kilns, furnaces or reactors independent of the source of heat or the insulating medium.

Any suitable type pusher can be used to push the unit of this invention via the grooves or channels through the length of the furnace. Typical pushers are hydraulic ram pushers or mechanical ball screw pushers supplied by Harper International Corporation of Lancaster, N.Y. Unlike several prior art systems, the structure of this invention allows the push points to be at each carrier thus equalizing the pressure on both sides ensuring even movement through the furnace without any substantial wobbling.

With the specific construction of the transport system of this invention there is no drag or obstacles or clogged tracks to slow or hinder movement through a furnace. It is important to this invention that the channels or grooves of this invention are surrounded by the refractory so that debris cannot enter the path of the carriers during their movement in the furnace. The terms "protected" or "guarded" will be used in this disclosure and in the claims to describe protective housing around the carriers to allow freedom of movement to the carriers but protect against any debris from falling into the channels or grooves and damaging or hindering the carriers. The carriers are guarded or enclosed throughout except for the small conduit through which the cross pieces extend. A center support with a channel for a central carrier may be used if desired for heavier loads. Insulation may be positioned around or near each carrier to prevent any heat damage to the carriers and provide constant positioning and support of the cross pieces.

DETAILED DESCRIPTION OF THE DRAWINGS AND PREFERRED EMBODIMENTS

Figure 1:
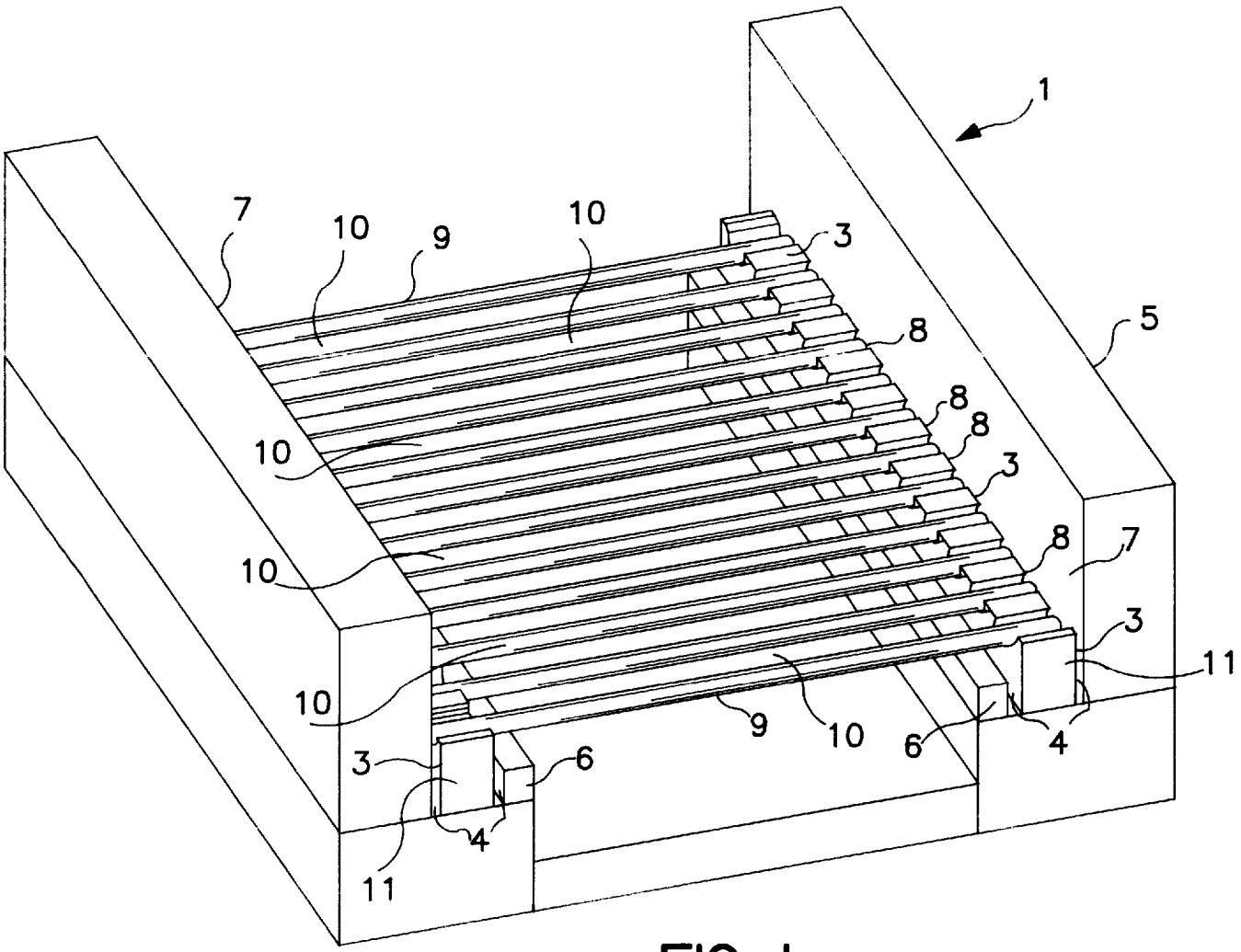
FIG. 1 is a cutaway perspective of the transport system of this invention minus the guards for the carrier.

In FIG. 1 the product transport system 1 of this invention is shown with the wrap around guards 2 (shown in FIGS. 2 and 3) omitted so that the remainder of the system can be clearly illustrated. Carriers 3 are positioned in grooves or channels 4 in refractory 5. These channels 4 extend throughout the length of the furnace or kiln being used. Inner abutments 6 together with refractory walls 7 keep the carriers 3 within the channels 4 when moving through the furnace. On the top portion of carriers 3 are furrows 8 into which the terminal ends of cross pieces 9 fit and are held firmly in place. Between each cross piece 9 may be substantial spaces 10 which permit heat to circulate on all faces of the work piece to ensure uniform heating and treatment. If the product placed on the cross pieces 9 are small, then the spaces may be reduced to provide proper support. A conventional pusher as earlier described will push the transport system 1 through a furnace by applying pressure on front carrier faces 11 to effectuate even pressure and avoid wobbling. Since an open atmosphere is provided, the work piece is uniformly heated and cooled.

The system 1 is simple and may be fast moving and is durable since there is little, if any, warping or heat degradation.

Figure 2:
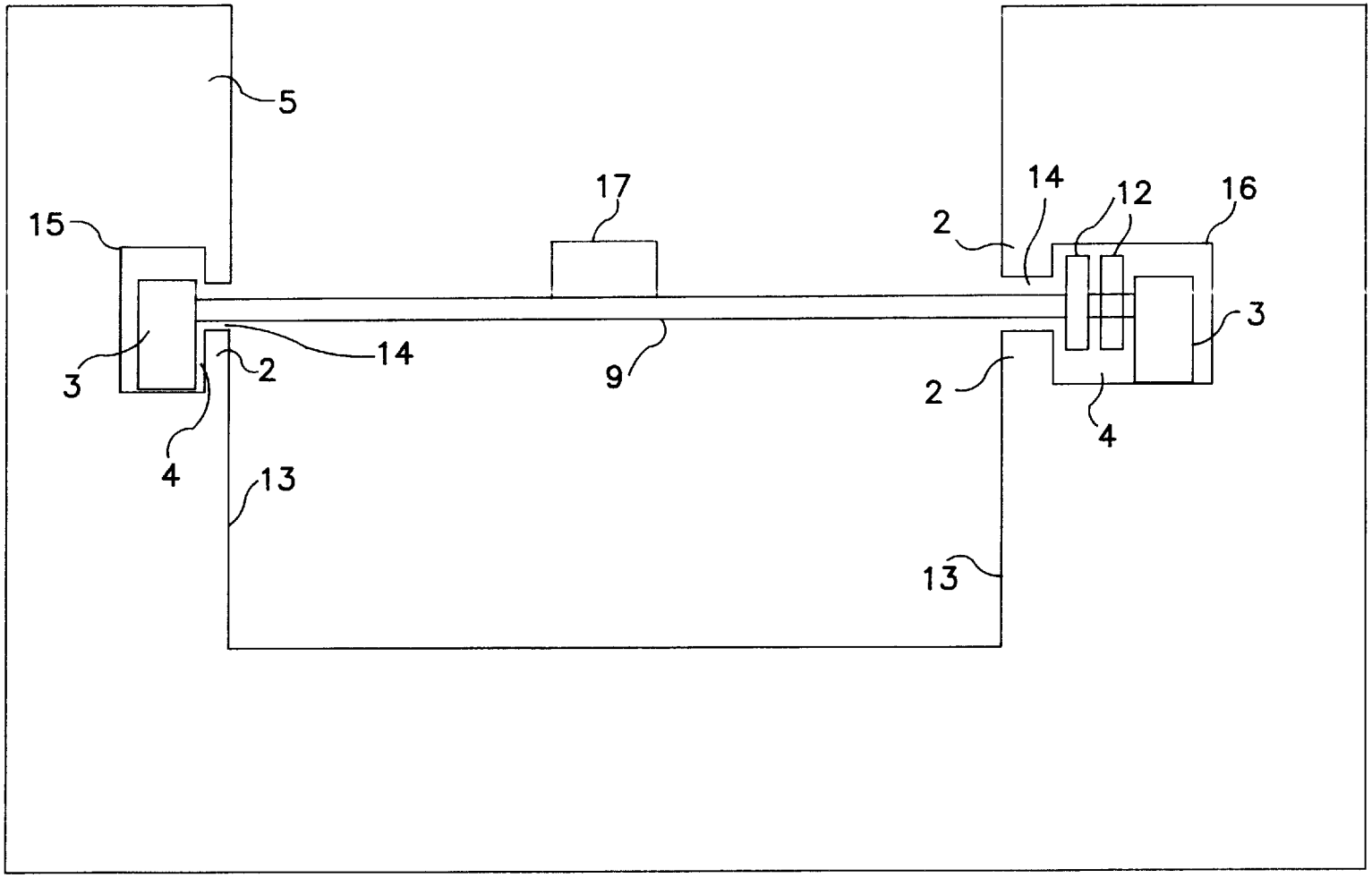
FIG. 2 is a section view of the transport system of this invention showing only two carriers.
Figure 3:
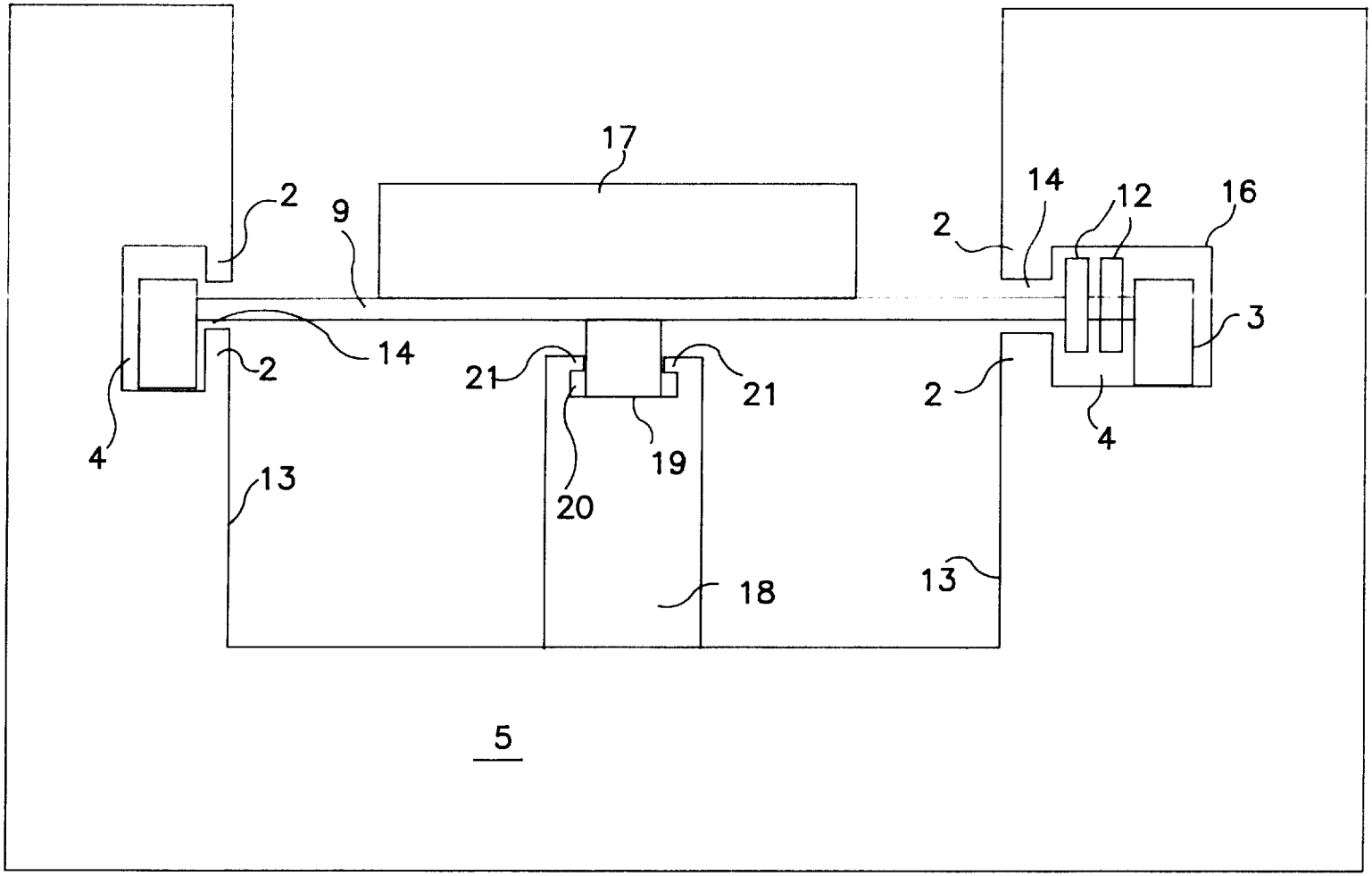
FIG. 3 is a section view of the transport system of this invention using a center support and center carrier to accommodate heavy loads.

In situations where intense heat is to be used, the carriers 3 may be insulated as shown in FIGS. 2 and 3. This insulation 12 prevents any substantial damage to carriers 3 during intense heat conditions and represents a component of a preferred embodiment of this invention.

In FIG. 2 carriers 3 are seen as housed in channels 4 built into inner refractory surface 13. Carriers 3 are completely enclosed except for a cross piece conduit or opening 14. This guards against any obstruction falling into the path of carriers 3 and impeding their path through the furnace or kiln. One side 15 of the system is shown without insulation 12 while the other side 16 is shown as a preferred embodiment with insulation baffles 12 located between the carrier 3 and the cross piece opening 14. In FIG. 3 a second configuration is illustrated which can be used when extremely heavy work pieces 17 are to be supported on cross pieces 9. An upwardly extending support 18 is located approximately mid-point of the array of cross pieces 9. A central carrier 19 is housed in central channel 20 which also has carrier guards 21 to prevent the accumulation of debris in central channel 20. Again, the carriers 3 supporting terminal ends of cross piece 9 are preferably insulated as shown on side 16 by the use of insulation baffles 12. The insulation 12 and wrap around guards 2 are not shown as noted above in FIG. 1 so that the other components of FIG. 1 can be clearly illustrated. Of course, more than one support 18 may be used depending upon the desired need. For example, any number of supports and carriers greater than two may be used within the concept of this invention. Extending support 18 is included as an integral part of refractory 5 and is included in the term "refractory" as used in the disclosure and claims.

Figure 4:
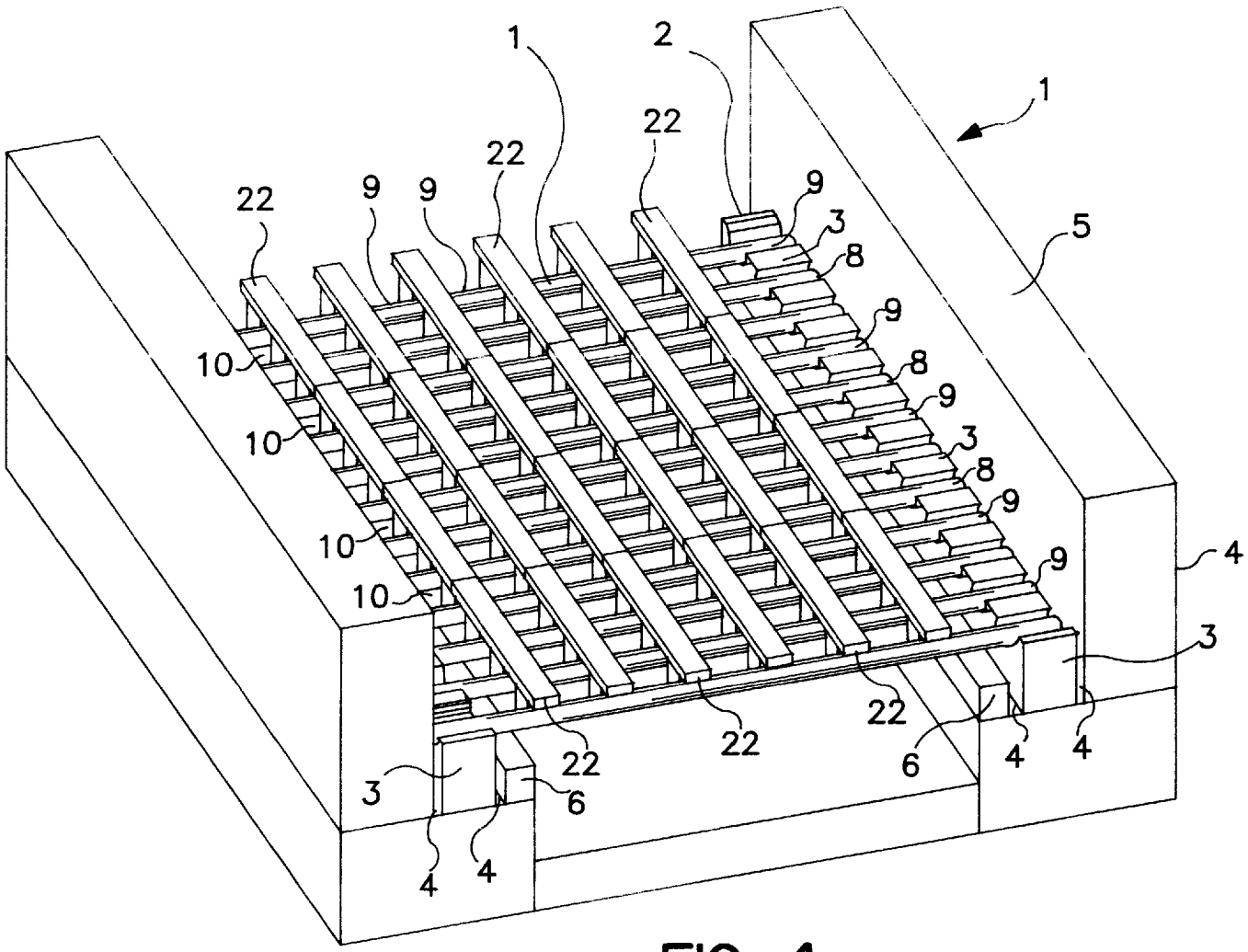
FIG. 4 is a cutaway perspective of the transport system of this invention showing the fixtures used between the cross pieces.

In FIG. 4 fixtures 22 are shown crossing the cross pieces 9 in a second embodiment of this invention. All other components remain the same. Any number of fixtures 22 may be used depending upon the product's shape and other features.

The preferred and optimumly preferred embodiments of the present invention have been described herein and shown in the accompanying drawing to illustrate the underlying principles of the invention but it is to be understood that numerous modifications and ramifications may be made without departing from the spirit and scope of this invention.

What is claimed is:

1. A product transport system for use in heat treating kilns or furnaces which comprises in combination an outer refractory, a plurality of cross pieces supported on at least two movable carriers or cross piece supporting structures, thereby forming a carrier/cross piece assembly, said outer refractory having inner grooves or channels through which at least two of said cross piece supporting structures or carriers will fit and travel with said cross pieces supported thereon, said cross pieces comprising a series of elongated and separated product supports having spaces there between, said movable cross piece supporting structure or carrier being slidably positioned in said channels having in an upper portion thereof indentations into which both terminal ends of said cross pieces fit, said carrier/cross piece assembly slidably movable through a length of said furnace via said inner grooves or channels, said outer refractory supporting at least two of said carriers.

2. The system of claim 1 wherein said cross pieces have the configuration of at least one of the following: rods, cylinders, wires, square bars, rectangular bars, square tubing, rectangular tubing, grid member or mixtures thereof.

3. The system of claim 1 wherein said carriers comprise a material selected from the group consisting of metal, ceramic, graphite, intermetallic, composite and mixtures thereof.

4. The system of claim 1 wherein said cross pieces comprise a material selected from the group consisting of metal, ceramic, graphite, intermetallic, composite and mixtures thereof.

5. The system of claim 1 wherein said carriers are substantially enclosed by a protective housing except for an opening through which said cross pieces extend.

6. The system of claim 1 wherein said cross pieces are supported by two carriers.

7. The system of claim 1 wherein said cross pieces are supported by more than two carriers.

8. The system of claim 1 wherein said carriers have insulation means adjacent thereto.

9. The system of claim 1 having at least one additional channel located between said end channels.

10. A transport system used to transport a work product through a furnace or kiln which comprises an outer refractory, a plurality of cross pieces, and at least two carriers supporting all of said cross pieces to form thereby a carrier/cross piece assembly, said outer refractory containing end channels or grooves along which said carriers will travel as they are pushed through a furnace, said channels positioned adjacent each terminal end of said cross pieces, said channels having guard means to prevent the entrance of debris into said channels, said carriers having in an upper portion thereof indentations into which both terminal ends of said cross pieces fit, said carriers and said cross pieces as said carrier/cross piece assembly movable along a length of said furnace via a path formed by said channels.

11. The system of claim 10 wherein said cross pieces have the configuration of at least one of the following: rods, cylinders, wires, square bars, rectangular bars, square tubing, rectangular tubing, grid member or mixtures thereof.

12. The system of claim 10 wherein said carriers comprise a material selected from the group consisting of metal, ceramic, graphite, intermetallic, composite and mixtures thereof.

13. The system of claim 10 wherein said cross pieces comprise a material selected from the group consisting of metal, ceramic, graphite, intermetallic, composite and mixtures thereof.

14. The system of claim 10 wherein said carriers are substantially enclosed by a protective housing except for an opening through which said cross pieces extend.

* * * * *